US005359307A

United States Patent [19]

Mahoney et al.

[11] Patent Number: 5,359,307

[45] Date of Patent: Oct. 25, 1994

[54] HIGH VOLTAGE RELAY

[75] Inventors: Steven A. Mahoney; David B. Cameron, both of McMinnville, Oreg.

[73] Assignee: Hewlett-Packard Corporation, Palo Alto, Calif.

[21] Appl. No.: 105,277

[22] Filed: Aug. 12, 1993

[51] Int. Cl.[5] ..... H01H 67/02

[52] U.S. Cl. ..... 335/128

[58] Field of Search ..... 335/78–86, 335/121, 151, 130

[56] References Cited

U.S. PATENT DOCUMENTS

| | | | |
|---|---|---|---|
| 3,070,730 | 12/1962 | Gray et al. | 335/78 |
| 3,689,856 | 9/1972 | Lambert et al. | 335/107 |
| 3,798,542 | 3/1974 | Dempsey | 324/133 |
| 3,981,950 | 6/1975 | DeLucia | 335/107 |
| 4,293,835 | 10/1981 | Davis et al. | 335/131 |
| 4,686,500 | 8/1987 | Ide et al. | 335/78 |

*Primary Examiner*—Lincoln Donovan

[57] ABSTRACT

A high-speed, relay for switching a high voltage signals includes a set of terminals across which the high voltage signal is applied. The relay also includes a motor having a shaft for movement between an open position and a closed position responsive to actuation of the motor. A contact plate is connected to the shaft which moves responsive to the shaft. A conductor having two contacts at distal ends is formed on the contact plate opposite the terminals such that the conductor does not contact the terminals in the open position and the conductor creates a short circuit across the terminals when in the closed position. The relay according to the invention permits the contact plate to be positioned closer to the terminals which results in a faster switching time.

14 Claims, 3 Drawing Sheets

HIGH VOLTAGE RELAY

BACKGROUND OF THE INVENTION

This invention relates generally to electromechanical relays and more particularly to high voltage relays having fast switching times.

Electromechanical switching relays have long been known and used in the art. The relay operates by passing a current through a wire wound coil to create a magnetic field which is used to close the relay. Thus, relays act as electromechanical switches.

Referring to FIG. 1, a prior art relay 10 is shown. The relay consists of a magnetic core 12, a coil 13, a pivot arm 14, and a conductive contact plate 16. The contact plate 16 has a first end that is hingedly mounted and a second end that moves between an open position as shown in FIG. 1 and a closed position wherein the second end is in electrical contact with a terminal 18. The first end remains in electrical contact with a terminal 20 in both the open and closed positions. An actuation signal is applied across terminals 24 and 26 to actuate the pivot arm which causes the plate to move between the open and closed positions.

A variety of applications require the relay to switch within a predetermined time. For example, one or more relays are used in a heart defibrillator to switch or shunt a stored charge through the patient to restore a normal heartbeat. The defibrillator must be able to apply the charge within a predetermined time or risk damaging a patient's heart. For example, when applying a therapeutic shock to the patient the charge must be applied within a predetermined time after R-wave detection.

An electrical schematic of a defibrillator, indicated generally at 30, is shown in FIG. 2. The series circuit consists of a capacitor C which is used as a charge storage means, a choke inductor L, two patient contact pads 32 and 34 which are applied to the patient, and relays R1 and R2 to shunt the charge. Typically, relays R1 and R2, rather than being separate relays, are actually a double pole double throw (DPDT) switch relay so that R1 and R2 operate in unison.

The switching time of the relay, as measured from the assertion of the actuation signal, is primarily determined by the distance D between the plate and the terminals, as shown in FIG. 1, and the combined mass of the plate and shaft. The obvious solution to decrease the switching time is to decrease the distance D between the plate and the terminals. The minimum distance between the plate 16 and terminals 18 and 20, however, is limited by the voltage applied to terminals 18 and 20, as described below. Defibrillators, which require fast switching times, also require high voltages, e.g., 5 KV. Thus, the conventional relay 10 is not well suited for defibrillator applications.

If the voltage applied to the terminals exceeds the breakdown voltage of the air between the terminals from the contact plate, an arc will form between the terminal and the contact plate. One solution to address the breakdown voltage problem is to enclose the terminals and contact plate in a pressure chamber and replace the air with a pressurized gas which has a higher breakdown voltage than air. An example of such a solution is a relay manufactured by Kilovac of Santa Barbara, Calif., part number KM-13/S31. The Kilovac part uses a sulfur hex fluoride gas under approximately three atmospheres of pressure. The pressure chamber, however, results in considerable added expense over the conventional relay.

Accordingly, a need remains for a relay for switching high voltages having a fast switching time which does not require a pressure chamber.

SUMMARY OF THE INVENTION

It is, therefore, an object of the invention to switch high voltages within a minimum amount time.

Another object of the invention is to repeatedly switch high voltages reliably and consistently.

A relay for switching high voltage is disclosed. The relay includes a set of terminals across which the high voltage signal is applied. The relay also includes a linear motor having a shaft for movement between an open position and a closed position responsive to actuation of the motor. A contact plate is connected to the shaft which moves responsive to shaft movement. A conductor having two contacts at distal ends is formed on the contact plate opposite the terminals such that the conductor does not contact the terminals in the open position and the conductor creates a short circuit across the terminals when in the closed position. The relay according to the invention permits the contact plate to be positioned closer to the terminals which results in a faster switching time.

An advantage of the invention is a greater amount of controllability of the acceleration and deceleration of relay which reduces contact bounce and thereby prolongs the life of the relay.

The foregoing and other objects, features and advantages of the invention will become more readily apparent from the following detailed description of a preferred embodiment of the invention which proceeds with reference to the accompanying drawings.

DETAILED DESCRIPTION

Figure 3:
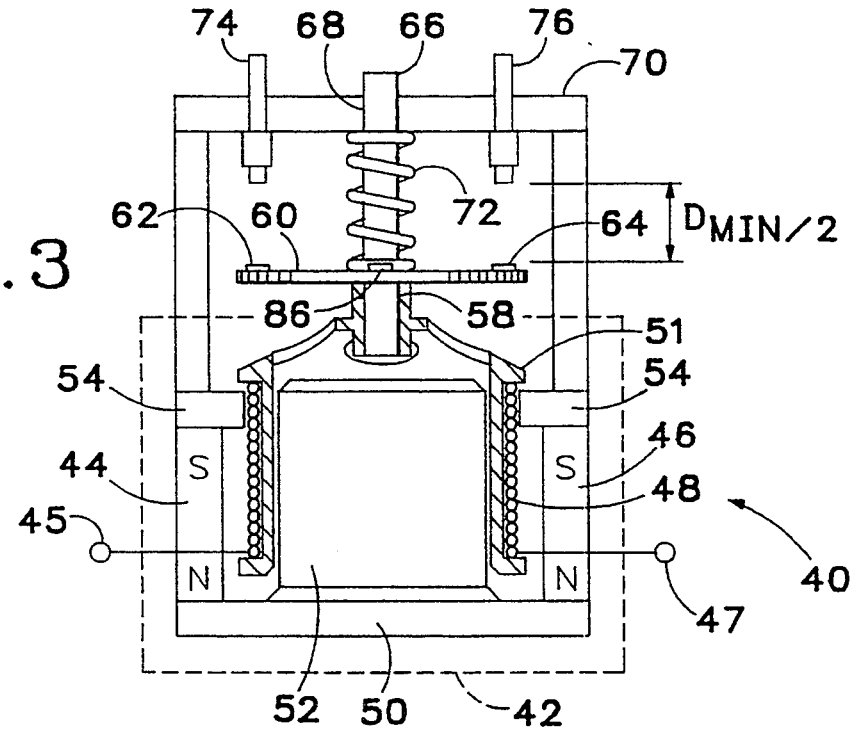
FIG. 3 is a cross section of a high-speed, high-voltage switching relay constructed in accordance with the present invention.
Figure 4:
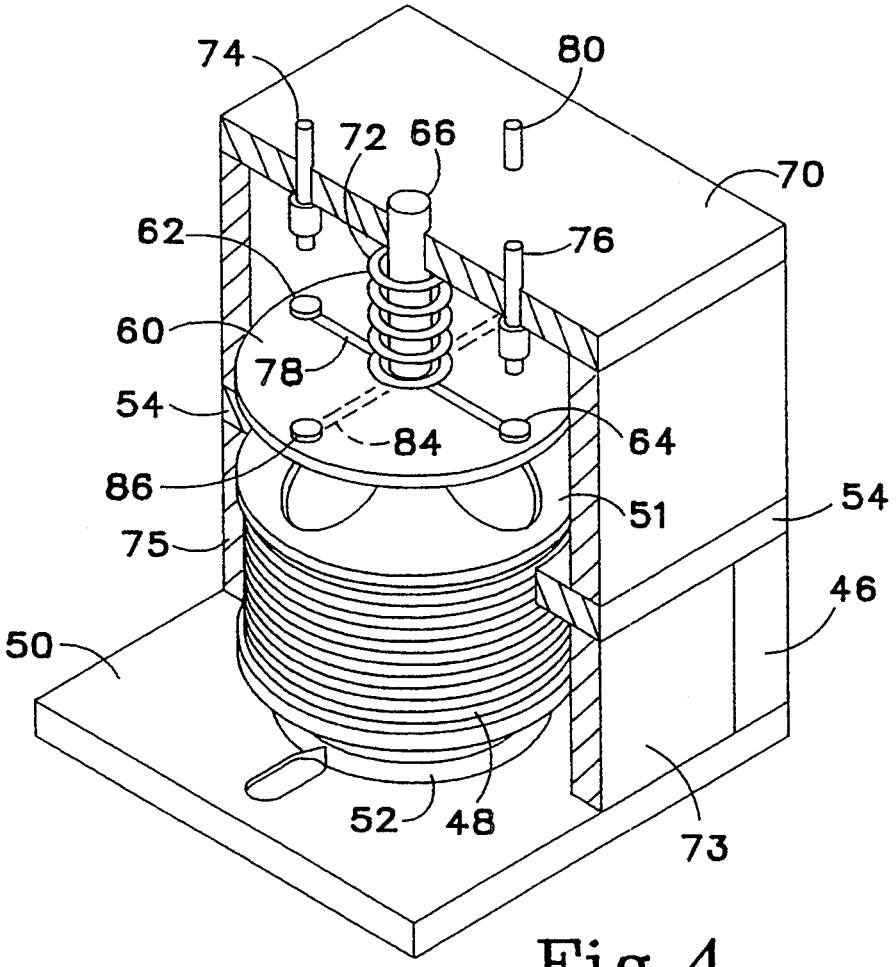
FIG. 4 is a perspective, partially-sectional view of the relay shown in FIG. 3.

Referring now to FIGS. 3 and 4, a high speed, high voltage switching relay 40 is shown. The cross section view of FIG. 3 is taken along an axis perpendicular to the partially-sectioned view of FIG. 4. Relay 40 includes a motor 42, which in the preferred embodiment is a linear-type motor. A linear motor is preferred because the force generated thereby can be varied by changing the actuation signal applied to the motor. The linear motor has an additional benefit of having a lower mass than other iron core type motors, which results in a faster switching time.

The motor consists of two permanent magnets 44, 46. The polarity of the magnets are as shown in FIG. 3. The magnets are mounted on opposite sides a base 50 which is magnetized by the permanent magnets 44, 46. A steel core 52 is mounted on base 50. Core 52 is constructed of similar type material as the base, preferably a soft magnetic material such as iron or steel. A member 54 is mounted on magnets 44 and 46. Member 54 is approximately equal in size to the base 50 but has a central opening formed therein to circumscribe a bobbin 51. The member 54 forms a part of a first magnetic loop consisting of magnet 44, member 54, core 52 and base 50. Similarly, member 54 forms a part of a second magnetic loop including magnet 46, member 54, core 52 and base 50.

Magnet 46 is separated from magnet 44 (not shown in FIG. 4) by a vertical, rectangular member 73 made of a non-magnetic material. Similarly, a vertical, rectangular member 75 of non-magnetic material separates magnets 44 and 46. Non-magnetic members 73 and 75 act as spacers and as such are not critical to the operation of the relay.

The bobbin 51 is slidingly engaged with core 52 to allow bobbin 51 to move freely along core 52. The bobbin 51 moves within an airgap formed between core 52 and member 54. The magnetic loops induce a high magnetic field across the air gaps. A conductor 48 having terminals 45, 47 is wound around bobbin 51 so that the conductor resides in the air gap.

The motor 42 operates in a conventional manner. An actuation signal is applied across terminals 45, 47 which induces a current through conductor 48. A current passes through the magnetic fields generated in the air gaps and thereby generates the force in a direction determined by the right hand rule.

Connected to the bobbin 51 is a shaft 58. Shaft 58 is further connected to a contact plate 60 having two contacts 62, 64 (also visible in FIG. 5A) at opposite ends of the contact plate 60. The contact plate 60 is separated from terminals 74 and 76 by a distance DMIN/2, the purpose of which is described further below. The two contacts 62, 64 have an electrical conductor 78 between them so that contacts 62, 64 are at the same voltage potential. A portion of the shaft extends from the contact plate through an opening 68 in a housing 70 to act as a guidepost 68 for movement of the contact plate 60 although this feature is not necessary to implement the invention.

In the preferred embodiment, a biasing spring 72 is used to bias the contact plate in a first open position as shown in FIG. 3. Spring 72 ensures that the relay is left in the open position when no actuation signal is applied.

Two high voltage terminals 74, 76 are located directly opposite contacts 62, 64 respectively. The terminals 74, 76 are positioned so that when the motor is actuated the contact plate 60 moves towards terminals 74, 76 until the contact plate 60 reaches a closed position. In the closed position, contacts 62, 64 are in physical contact with terminals 74, 76, respectively. Because contacts 62, 64 are electrically connected by the conductor 78, when the relay is in the closed position the conductor 78 creates a short circuit between terminals 74, 76.

The guidepost 66 helps to ensure that the contacts 62, 64 make physical contact with terminals 74, 76, respectively, approximately simultaneously. Simultaneous contact eliminates the potential for an arc to form when one contact and terminal pair are in physical contact and the other pair remain separated.

Referring now to FIG. 4, a perspective view of a cutaway of the relay 40 is shown. The cutaway shows the preferred embodiment of the relay 40 having a solid cylindrical core 42 and a hollow cylindrical bobbin 51. Also, in the preferred embodiment, bobbin 51 is made of a thin aluminum to minimize the mass. The bobbin 51 can also have portions of a top surface removed by forming holes therein to further reduce the mass of the bobbin.

The contact plate 60, in the preferred embodiment, is a circular disc formed of a nonconductive plastic to reduce the weight of the plate. Contacts 62, 64 have a conductor 78 formed on the surface of plate 60. The conductor must be sized in order to conduct a large current, e.g., 60 amps. The conductor has a semicircular protrusion about its midpoint to circumvent the guidepost 66. Alternatively, the contact plate 60 can be formed of a common printed circuit board material and conductor 78 can be formed using conventional circuit board techniques.

In the preferred embodiment, relay 40 is a double-pole, double-throw relay in order to be employed in the defibrillator, as described above. Accordingly, a second set of contacts is formed on plate 60. The cutaway shown in FIG. 4 has a contact 82 and an associated conductor 84 which is in electrical connection with an additional contact 86 not visible in FIG. 4. A terminal 80 is mounted on housing 70 opposite the associated contact 82. Similarly, contact 86 has an associated terminal (not visible) mounted on the housing opposite terminal 80. Two potential layouts of the two sets of contacts and their associated conductors are shown in FIGS. 5A and 5B.

Figure 5A:
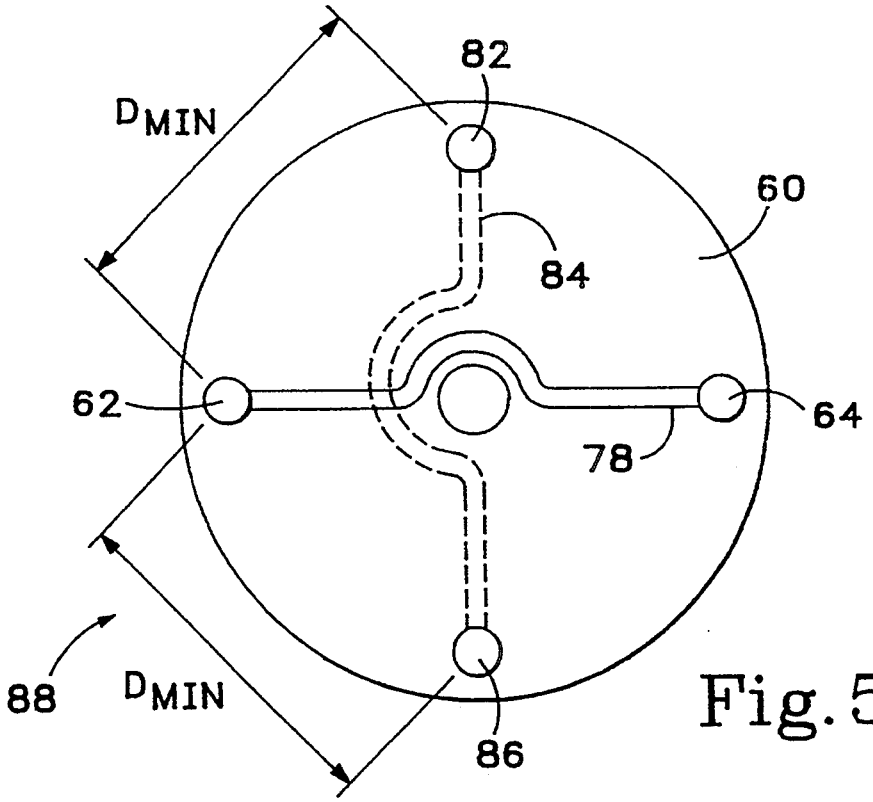
FIG. 5A is a top view of a first embodiment of the contact disk of FIGS. 3 and 4 according to the invention.
Figure 5B:
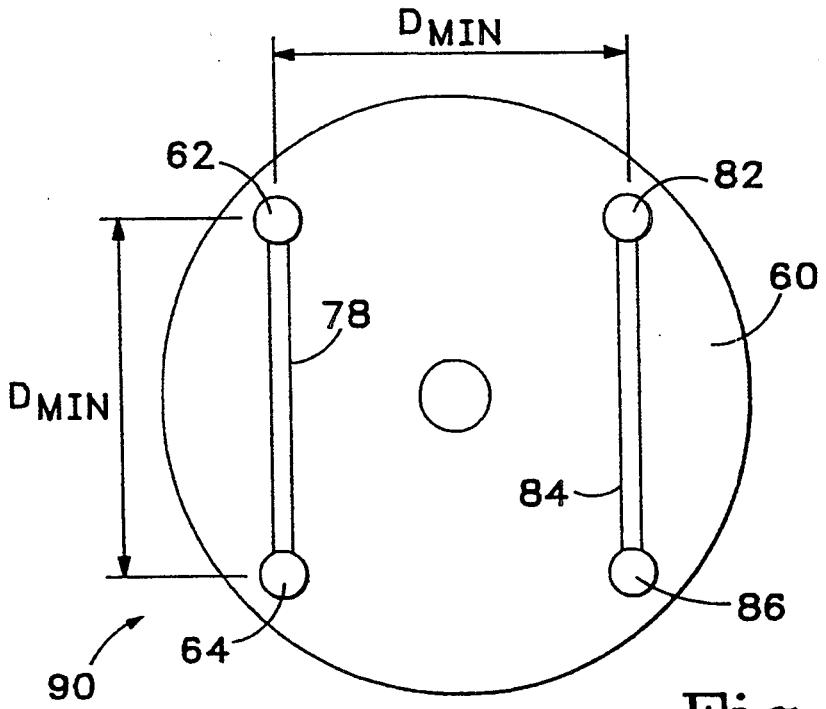
FIG. 5B is a top view of another embodiment of the contact disk according to the invention.

Referring now to FIGS. 5A and 5B, two embodiments of the contact plate 60 are shown. A first embodiment 88 has contacts 62, 64 positioned on opposite sides of the disk and conductor 78 is running therebetween. Similarly, the second set of contacts 82, 86 are positioned on opposite sides of the contact plate with conductor 84 running therebetween. The first set of contacts and the second set of contacts are displaced by 90 degrees from each other on the plate. Conductors 78, 84 are preferably formed on separate layers of a multilayer printed circuit board to provide isolation between the conductors.

In FIG. 5B, a second embodiment of the contact plate 90 is shown. In the second embodiment, contacts 62, 64 are positioned on the same half of the contact plate 90 with conductor 78 running directly therebetween. On an opposite side of the contact plate 90, contacts 82, 86 are formed with conductor 84 directly connecting them. The second embodiment 90 allows for a single layer of printed circuit board to be used because the conductors 78, 84 do not cross.

In FIGS. 5A and 5B, all of the contacts must be separated by a minimum distance $D_{MIN}$ to prevent an arc from forming therebetween. Thus, the minimum distance $D_{MIN}$ establishes a limitation on the size of the contact plate. For example, under worst case conditions the breakdown voltage of air requires a separation of 3 mm/KV. Thus, for a 5.3 KV signal, the typical voltage of a defibrillator, $D_{MIN}$ equals approximately 0.626 inches.

Figure 1:
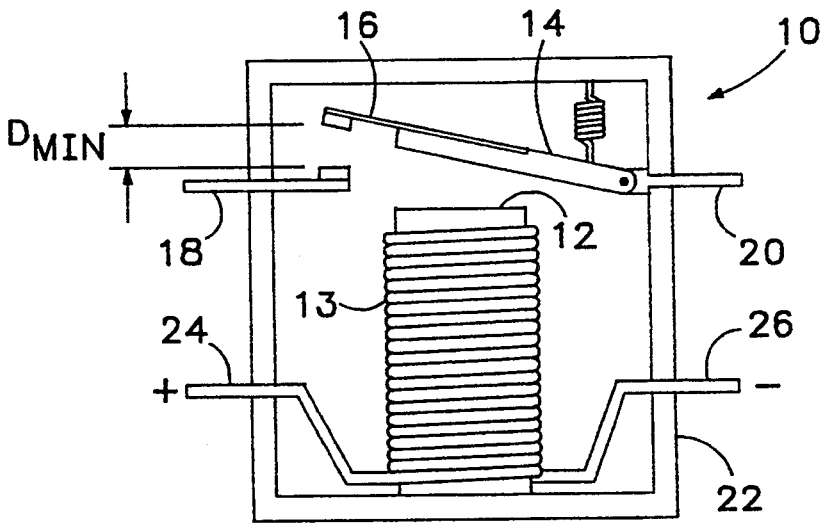
Fig. 1 (PRIOR ART)
FIG. 1 is a schematic of a prior art relay.
Figure 2:
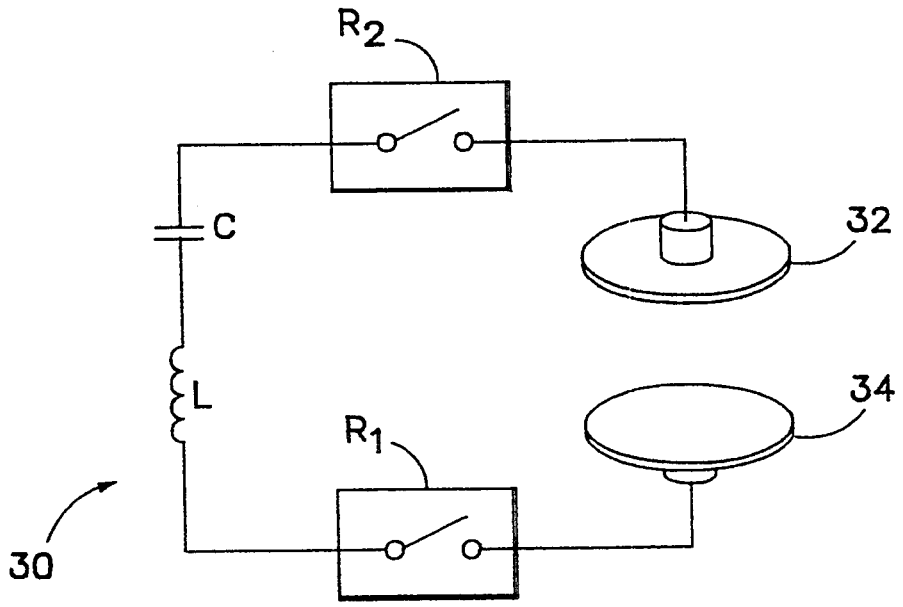
FIG. 2 is a simplified electrical schematic of a defibrillator apparatus.

This minimum distance $D_{MIN}$ also determines the separation of the contact plate from the terminals in the prior art relay of FIG. 1. In the prior art, as described above, this distance set a fundamental limitation on the switching time of the relay. However, according to the invention, the contact plate and therefore the conductors are only separated from the terminals by one-half $D_{MIN}$, i.e., $D_{MIN}/2$. The separation between the terminals 74, 76 and the conductor 78 can be reduced because the air must breakdown between both terminal 74 and contact 62 and terminal 76 and contact 64. Therefore, the invention has twice the effective separation distance for purposes of calculating breakdown voltage. Accordingly, the relay 40 has a faster switching time for high voltages, without requiring a pressurized chamber, because the conductor has less distance to travel to close the relay. Furthermore, the relay herein described has a lower mass than existing high voltage relays which further reduces the switching time.

In operation, the actuation signal is varied to precisely control the acceleration and deceleration of the contact plate 60. The force created by the linear motor is proportional to the amplitude of the actuation signal. In addition, the linear motor creates both repulsive and attractive forces responsive to an actuation signal of a first polarity and an actuation signal of a second, opposite polarity, respectively. The acceleration of the contact plate 60 is precisely controlled by varying both the amplitude and sign of the actuation signal, as illustrated in the example below.

Initially, with the relay in the closed position, an actuation signal is applied having the first polarity and a predetermined, maximum amplitude. This produces the maximum initial repulsive force and, therefore, a maximum acceleration. As the contact plate nears the terminals 74 and 76, however, a second actuation signal is applied having the second, opposite polarity. The second actuation signal produces an attractive force which causes the contact plate 60 to decelerate. Finally, a third actuation signal is applied having the first polarity which causes the relay to close and which maintains the relay in the closed position. The sequence of actuation signals described is illustrative of the controllability of the high voltage relay herein described. The ability to decelerate the contact plate prior to contact reduces contact bounce and increases the life span of the contacts.

Having described and illustrated the principles of the invention in a preferred embodiment thereof, it should be apparent that the invention can be modified in arrangement and detail without departing from such principles. For example, additional numbers of contacts can be added to the conductor to further increase the effective separation distance, which allows the conductor to be separated from the terminals by DMIN divided by the number of contacts.

We claim:

1. A high voltage double pole, double throw relay assembly comprising:

a first pair of terminals across which a high voltage signal is applied;

a second pair of terminals across which a second high voltage signal is applied;

a motor having a shaft for movement between an open position and a closed position in response to an actuation signal applied to said motor; and a nonconductive contact plate mounted to said shaft, said nonconductive contact plate having a first conductor mounted linearly along a top surface thereof and a second conductor disposed thereon, said nonconductive contact plate movable from said open position distant from said first and second pairs of terminals to said closed position in which said first conductor contacts both of said first pair of terminals and said second conductor contacts both of said second pair of terminals, substantially simultaneously.

2. The high voltage double pole, double throw relay assembly according to claim 1, wherein said nonconductive contact plate comprises a circular disc.

3. The high voltage double pole, double throw relay assembly according to claim 1, wherein said second conductor is mounted substantially parallel to said first conductor.

4. The high voltage double pole, double throw relay assembly according to claim 1, wherein said first conductor is substantially mutually perpendicular with said second conductor.

5. The high voltage double pole, double throw relay assembly according to claim 1, wherein said motor is a linear motor.

6. The high voltage double pole, double throw relay assembly according to claim 1, wherein said motor comprises:

a base;

a first magnetic means mounted on said base;

a second magnetic means mounted on said base opposite said first magnetic means;

a bobbin positioned between said first and second magnetic means for movement between said open position and said closed position; and a motor conductor wrapped around said bobbin such that a current passed through said motor conductor produces a force upon said bobbin.

7. The high voltage double pole, double throw relay assembly according to claim 6, wherein said bobbin is constructed of aluminum and has a plurality of openings formed in a top surface thereof to minimize the mass of said bobbin.

8. A defibrillator comprising:

first and second patient contact pads;

charge storing means in series with said first and second patient contact pads;

a high voltage double pole, double throw relay assembly comprising:

a first pair of terminals for coupling said charge storing means to said first patient contact pad;

a second pair of terminals for coupling said charge storing means to said second patient contact pad;

a motor having a shaft for movement between an open position and a closed position in response to an actuation signal applied to said motor; and a nonconductive contact plate mounted to said shaft, said nonconductive contact plate having a first conductor mounted linearly along a top surface thereof and a second conductor disposed thereon, said nonconductive contact plate movable from said open position distant from said first and second pairs of terminals to said closed position in which said first conductor contacts both of said first pair of terminals and said second conductor contacts both of said second pair of terminals, substantially simultaneously.

9. The defibrillator according to claim 8, wherein said nonconductive contact plate comprises a circular disc.

10. The defibrillator according to claim 8, wherein said second conductor is mounted substantially parallel to said first conductor.

11. The defibrillator according to claim 8, wherein said first conductor is substantially mutually perpendicular with said second conductor.

12. The defibrillator according to claim 8, wherein said motor is a linear motor.

13. The defibrillator according to claim 8, wherein said motor comprises:

a base;

a first magnetic means mounted on said base;

a second magnetic means mounted on said base opposite said first magnetic means;

a bobbin positioned between said first and second magnetic means for movement between said open position and said closed position; and a motor conductor wrapped around said bobbin such that a current passed through said motor conductor produces a force upon said bobbin.

14. The defibrillator according to claim 13, wherein said bobbin is constructed of aluminum and has a plurality of openings formed in a top surface thereof to minimize the mass of said bobbin.

* * * * *